United States Patent [19]

Mon

[11] 4,434,813

[45] Mar. 6, 1984

[54] LAMINAR PROPORTIONAL AMPLIFIER AND LAMINAR JET ANGULAR RATE SENSOR WITH ROTATING SPLITTER FOR NULL ADJUSTMENT

[75] Inventor: George Mon, Silver Spring, Md.

[73] Assignee: The United States of America as represented by the Secretary of the Army, Washington, D.C.

[21] Appl. No.: 323,146

[22] Filed: Nov. 19, 1981

[51] Int. Cl.[3] ..... F15C 3/00

[52] U.S. Cl. ..... 137/829

[58] Field of Search ..... 137/829, 830, 831, 832

[56] References Cited

U.S. PATENT DOCUMENTS 3,053,276 9/1962 Woodward ..... 137/829
3,590,842 7/1971 Amos et al. ..... 137/829
3,754,576 8/1973 Zetterstrom et al. ..... 137/829
4,241,760 12/1980 Mon ..... 137/829

*Primary Examiner*—A. Michael Chambers
*Attorney, Agent, or Firm*—Robert P. Gibson; Anthony T. Lane; Saul Elbaum

[57] ABSTRACT

The apparatus disclosed herein is an externally adjustable flow splitter for a fluid amplifier. The flow splitter is a substantial triangular plate fixedly attached to a rod rotatably mounted in the amplifier immediately adjacent to the fluid outputs to redirect fluid flow through to the fluid outputs of a fluid amplifier to null the amplifier. The rod extends externally of the amplifier and is threaded to receive externally a lock nut which can be threaded down on the rod to secure the position of said triangular plate.

8 Claims, 6 Drawing Figures

LAMINAR PROPORTIONAL AMPLIFIER AND LAMINAR JET ANGULAR RATE SENSOR WITH ROTATING SPLITTER FOR NULL ADJUSTMENT

RIGHTS OF THE GOVERNMENT

The invention described herein may be manufacture, used and licensed by or for the U.S. Government for governmental purposes without the payment to me of any royalties thereon.

BACKGROUND OF THE INVENTION

As fluidic systems require more gain and higher precision when operating over the military temperature range, the problem of null offset has become more important in designing these fluidic systems. Null offset is the inherent tendency of a fluid amplifier to direct more flow to a given output from an input fluid stream due to inherent geometrical asymmetries in a fluid amplifier plate. Sometimes a small amount of null offset in the sensor can saturate the output of a high gain amplifier or produce an erroneous output signal. As a result, it can degrade the performance of the fluidic system and sometimes even makes the system inoperative. The problem of null offset is mainly caused by the inability to produce a symmetrical sensor or amplifier. Any misalignment between the supply nozzle and the splitter will produce a null offset. Mismatch between the two output channel or input channel resistances will also produce a null offset. In other words, any geometric asymmetry along the center line of the amplifier plate will produce a differential output signal without the presence of an input control signal.

There are many methods, such as negative feedback, that can be used to minimize the null offset problem. The method of using a moveable splitter appears to be an effective means to minimize the null offset problem in both the fluidic amplifiers and sensors.

OBJECTS OF THE INVENTION

It is an object of this invention to create a structure for fluid amplifiers which allows an individual to properly balance the pressure, and flow through the amplifier to properly reflect an input signal in the output amplifiers.

It is another object of this invention to create an inexpensive method to adjust the amplifier to create output conditions which properly reflect the control pressure input by adjusting a flow splitter to apportion flow between the outlets.

It is a further object of this invention to inexpensively and exactly adjust a null offset in the flow splitter to properly apportion flow between the various outlets to produce a proper signal.

SUMMARY OF THE INVENTION

This and other objects of the invention are achieved through supplying a fluid amplifier having a fluid input, control pressure inputs to supply a control pressure to control fluid input, variable position flow splitter for splitting the supply stream between at least two output receivers, and outputs to allow the fluid to be evacuated from the fluid amplifier. In this invention, the flow splitter between the output receivers comprises a generally triangular plate which is fixedly mounted to a rod which is rotatively mounted in the body of the amplifier to allow the generally triangular flow splitter to be rotated to properly apportion flow between two outlets.

A locking nut is provided to lock the plate in position to prevent it from being displaced subsequent to the flow splitting adjustment. These and other objects of the invention are achieved in the embodiments disclosed below.

In the device described, drawing features which have the same functions receive the same numerical designation.

DETAILED DESCRIPTION OF THE INVENTION

Figure 1:
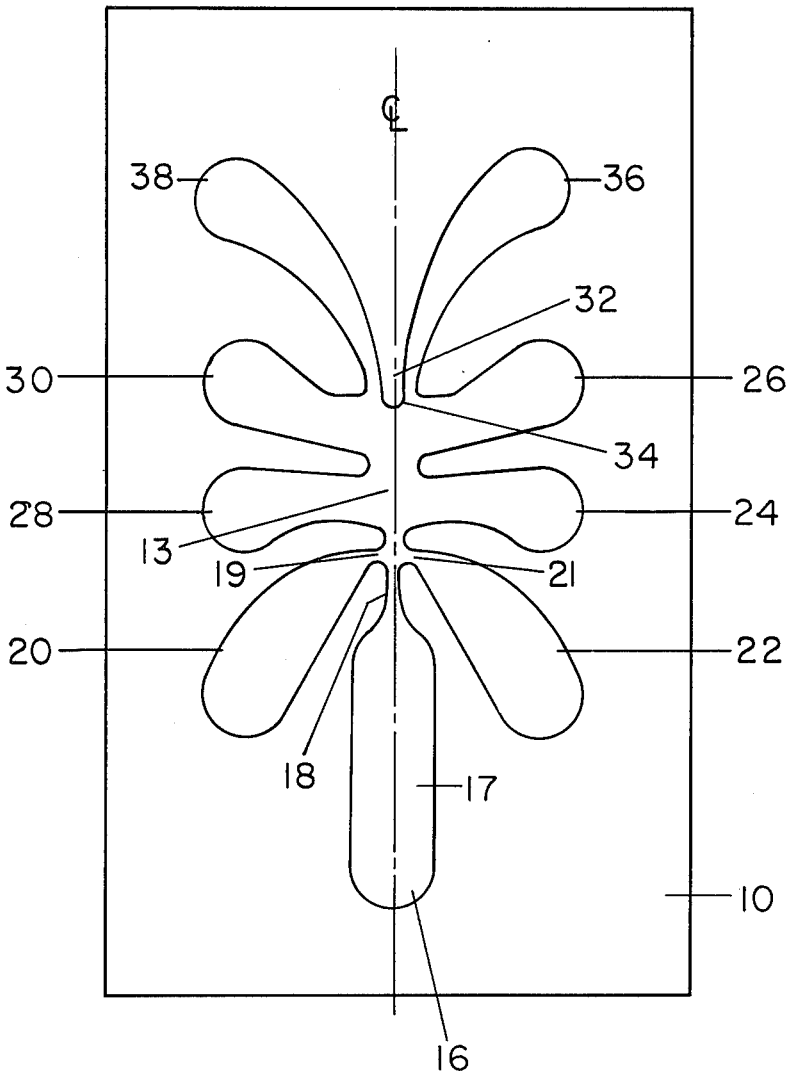
FIG. 1 discloses a plan view of a conventional fluid amplifier plate showing a fixed position flow splitter.

In FIG. 1 can be seen a conventional amplifier having a fixed position flow splitter. In FIG. 1, amplifier 10 is sandwiched between backing plates (not shown) wherein the voids in amplifier plate 10 and the backing plates combine to create a void in which fluid can flow. In the amplifier plate 10, fluid input 16 is shown having an elongated fluid path 17 and a supply nozzle 18. Incoming fluid passes through supply nozzle 18 through the amplifier body and out fluid output ports 36 and 38. The fluid flow that comes out nozzle 18 is controlled by fluid entering through control ports 20 and 22 through control nozzles 19 and 21 respectively. These control nozzles 19 and 21 direct the fluid flow out of the supply nozzle 18 toward either of the fluid output ports 36 or 38 and are provided with vents 24, 26, 28, and 30 to allow the fluid supply to exit in the event that there is a clog in the fluid output ports 36 or 38 or to allow adjustments for ambient pressure changes.

The fluid proceeds down fluid passage 13 and encounters the conventional flow splitter 32 which divides the fluid flow into one of two paths. The flow splitter leading edge 34 splits the flow and directs the fluid into fluid output 36 or fluid output 38 when the fluid stream is directed by pressures from the control nozzles 19 and 21. The direction of fluid flow is directed by control fluid coming out of the control nozzles 19 and 21 which can apply pressure to either side of the fluid flow to direct it towards the proper outputs 36 or 38. In the conventional embodiment shown in FIG. 1, flow splitter 32 has a fixed flow splitter leading edge 34 directly down stream of the outlet nozzle 18 which directs the flow onto either side of leading edge 34 to the fluid outputs 36 or 38 respectively. The control ports 20 and 22 can supply fluid which goes out of nozzles 19 and 21 respectively to direct the fluid flow from supply nozzle 18 to either side of the leading edge 34 to the outputs 36 and 38. In this manner, the fluid flow within the amplifier can be directed by the fluid flow in the control ports 20 and 22.

Problems have been known to arise with the amplifier plate shown in FIG. 1, when the conventional flow splitter 32 is inherently asymmetrical and does not directly align with the supply nozzle 18. If flow splitter 32 is not properly displaced relative to the supply nozzle 18, fluid will disproportionally flow into either outlet port 36 or 38. As such, the fluid amplifier will produce false signals which inherently create false readings eminating from fluid outputs 36 or 38.

Figure 2:
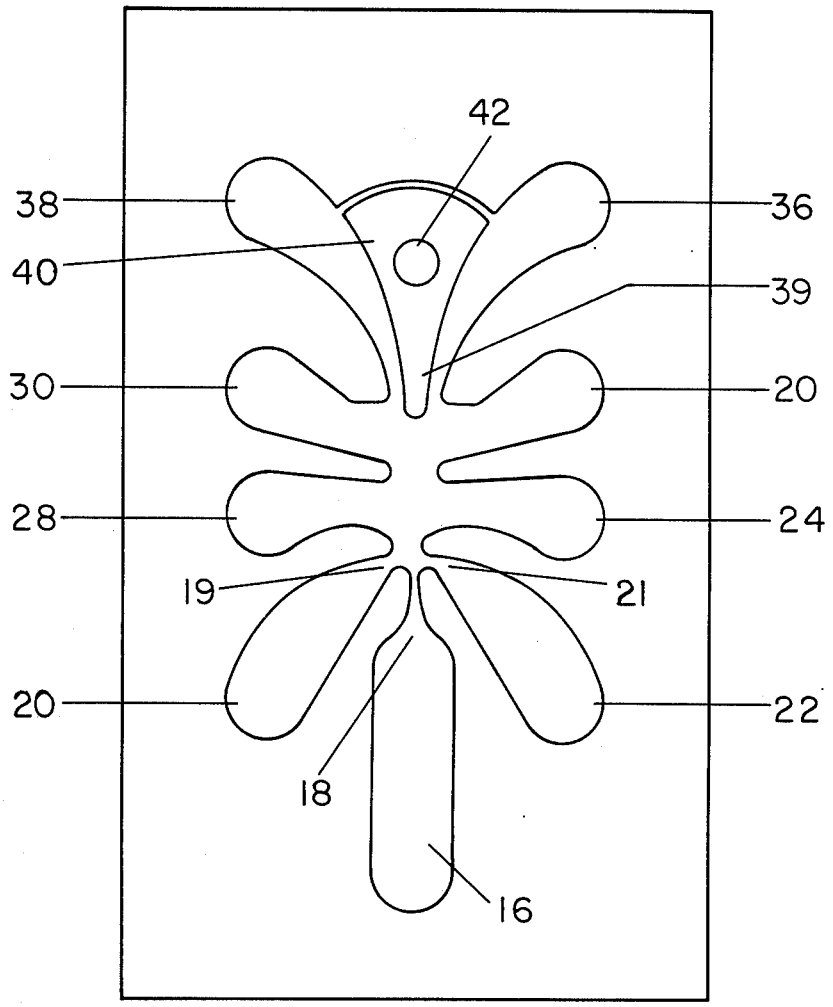
FIG. 2 is a plan view of a fluid amplifier plate having an adjustable null offset flow splitter.

An improved version of the fluid amplifier plate 11 is seen in FIG. 2. The improved plate 11 has the same fluid input 16, supply nozzle 18, control ports 20, 22, control nozzles 19 and 21, vents 24, 28, 30, and 26 and fluid outputs 36 and 38 as a conventional fluid amplifier. The improvement resides in the moveable flow splitter 39 which divides flow between outputs 36 and 38. Moveable flow splitter 39 comprises a substantially triangular plate 40 which is fixedly attached to a rod 42 which is rotatable mounted in the backing plate 12 (see FIG. 4). Triangular plate 40 is connected to rod 42 at connection 44 and rotates with the rod 42 as it rotates in opening 50 in backing plate 14 (see FIG. 4). When a null offset is detected, triangular plate 40 may be rotated by rotating rod 42.

Figure 4:
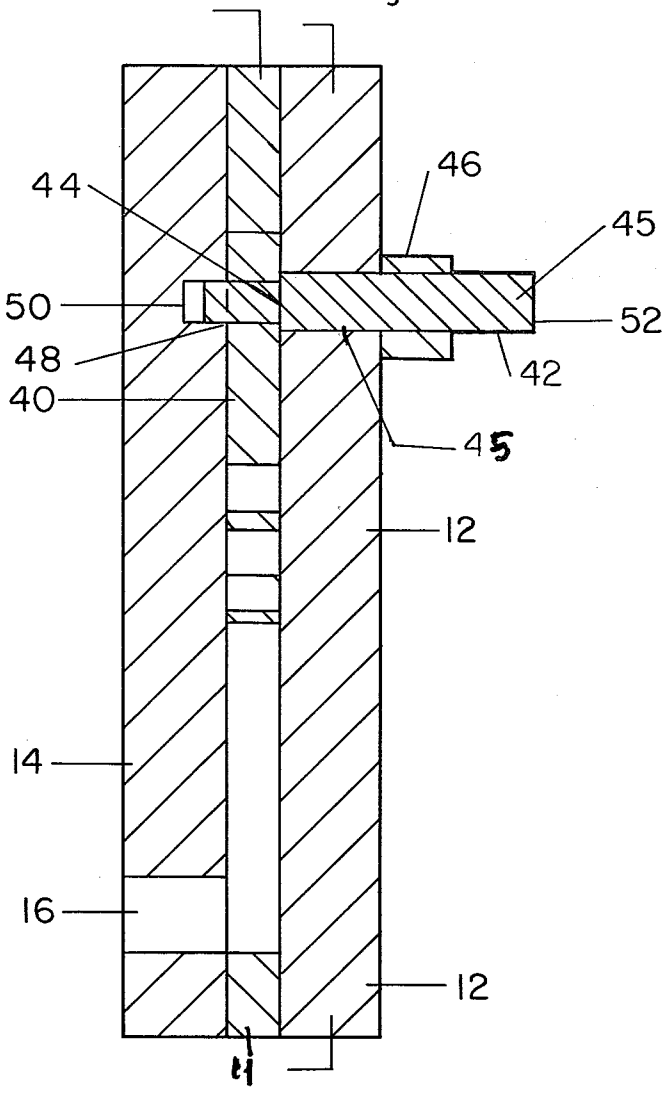
FIG. 4 discloses a side cross sectional view through lines AA of FIG. 3 of an embodiment of the current invention.
Figure 3:
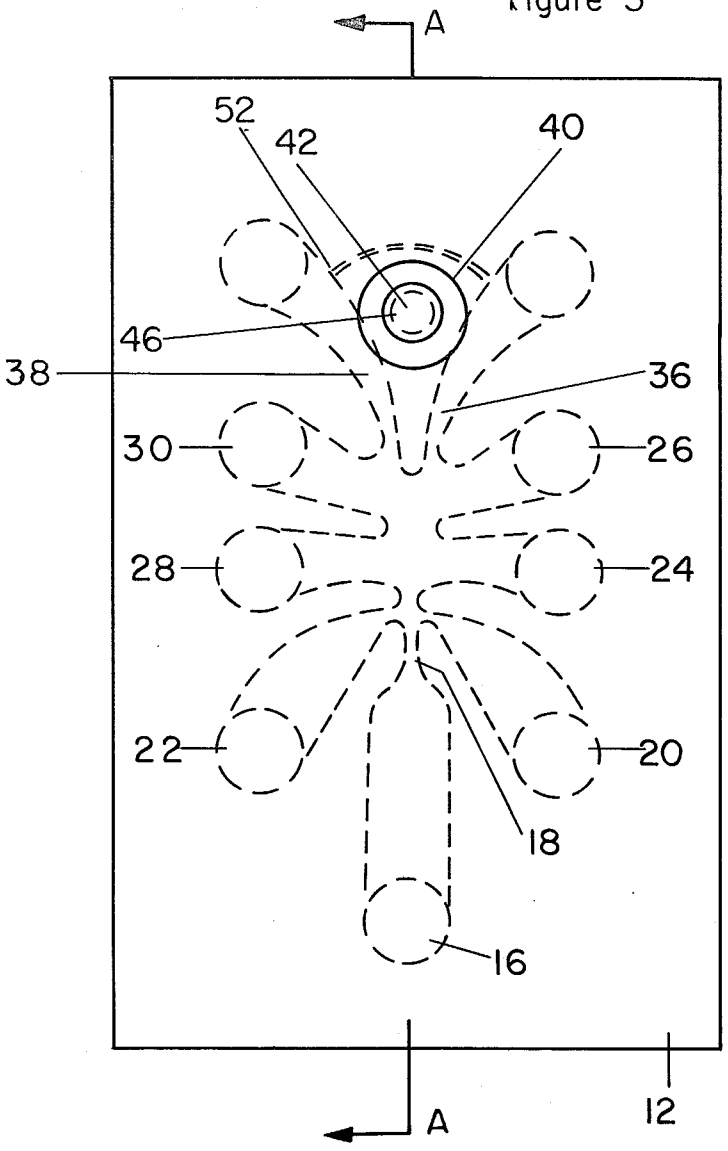
FIG. 3 is a plan view of the fluid amplifier of the current invention showing the structure of the fluid amplifier plate in phantom lines.

A fluid amplifier can be seen in plan view in FIG. 3 and in side cross sectional view in FIG. 4 with cover plate 12 fixed to the front of it. The fluid amplifier plate 11 is shown in phantom lines in FIG. 3. Triangular plate 40 rotates about rod 42 which is positioned between the outputs 38 and 36. Triangular plate 40 may be rotated to direct flow into fluid outputs 36 and 38 respectively. By selectively directing fluids in fluid output 36 or 38, an individual may eliminate a null offset to balance fluid flow through these fluid outputs when the amplifier is in a null condition.

As seen in FIGS. 3 and 4, the triangular plate 40 is secured in place by a rod 42 and lock nut 46. Rod 42 has a large diameter portion 45 and a turning portion 48 coaxially aligned therewith which turns in aperture 50 located in the backing plate 14 as noted previously, triangular plate 40 is secured to rod 42 at connection 44 and rotates therewith. The triangular plate 40 can be rotated by rotating rod 42 via rotating means 52 located on top portion of rod 42 from outside the amplifier. Once the triangular plate 40 has been properly positioned to properly direct flow, the rod is then fixed in position by lock nut 46 which is in threatedly connected to rod 42. Lock nut 46 is tightened down to engage backing plate 12. When lock nut 46 is threaded down to engage backing plate 12, the position of the triangular plate 40 is secured and the amplifier is in a fixed state to respond to fluid flow over its surfaces. When lock nut 46 is fastened down to rod 42, the triangular plate 40 is rotated by rotating rod 42 externally of the amplifier to proper position and the lock nut 46 may be then secured in postion to lock the newly effective null point condition in place and prevent any rotation of triangular plate 40 relative to fluid outputs 36 and 38.

Figure 5:
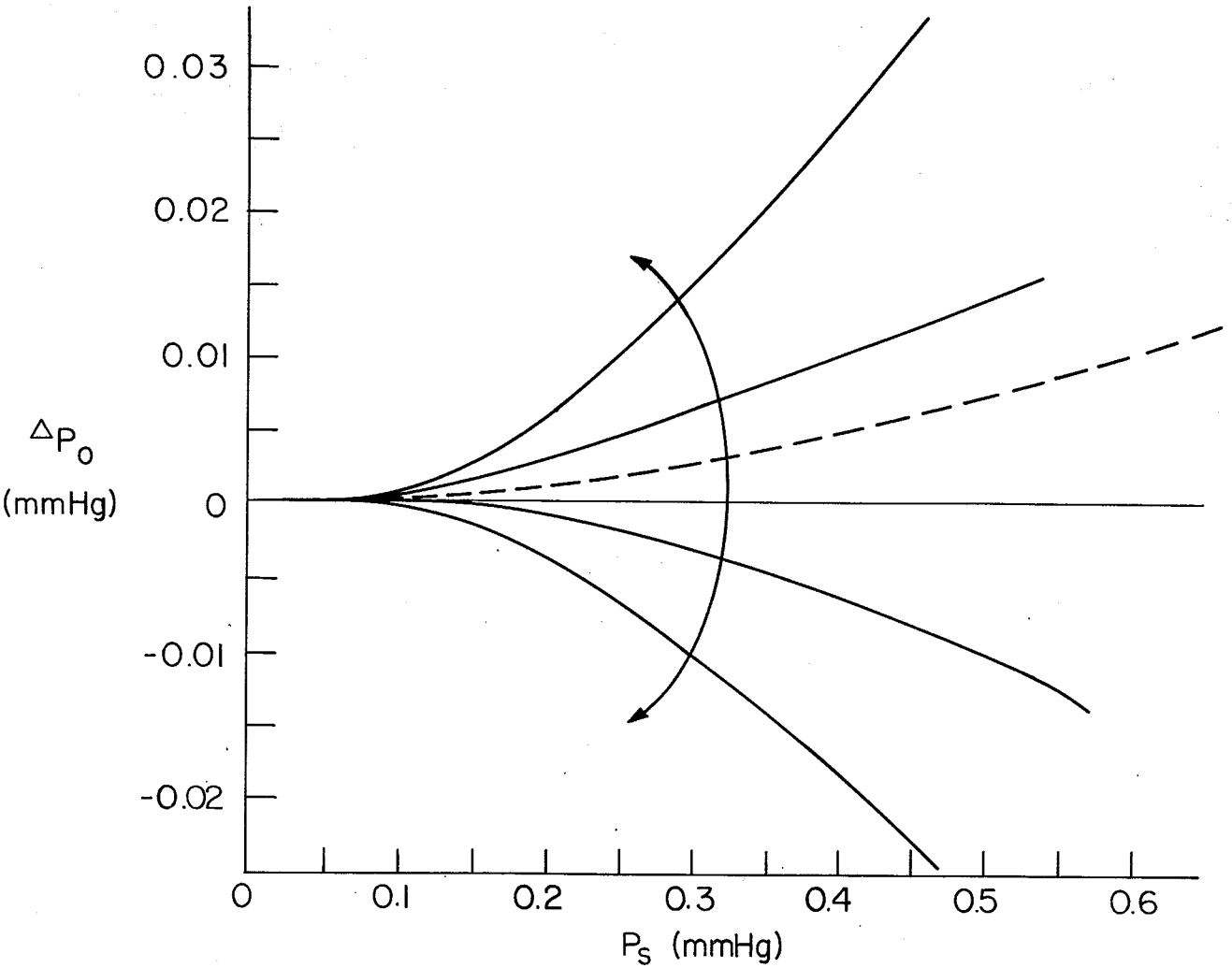
FIG. 5 is a graph showing the input pressure versus the variation of the differences between the two output pressures in the fluid amplifier of an example of the current invention.

FIG. 5 shows a graph of supply pressure provided by the supply input versus the difference in pressure between the two outlets. The dotted line in this case shows the best available proportional amplifier performance without a null offset adjustment provided by moving triangular plate 40 relative to the flow of fluid from nozzle 18. The output difference between first output and the second is measured and is shown in the ordinant on this graph which indicates differences between the measured pressure of each output shown as $\Delta p_o$. A $\Delta p_o$ variation in the plus direction above zero occurs with a clockwise rotation of the triangular plate and a minus value for $\Delta p_o$ occurs with a counter-clockwise rotation of the triangular plate. As can be seen from FIG. 5, the null offset can be adjusted to approximate zero by properly rotating the triangular plate 40.

Figure 6:
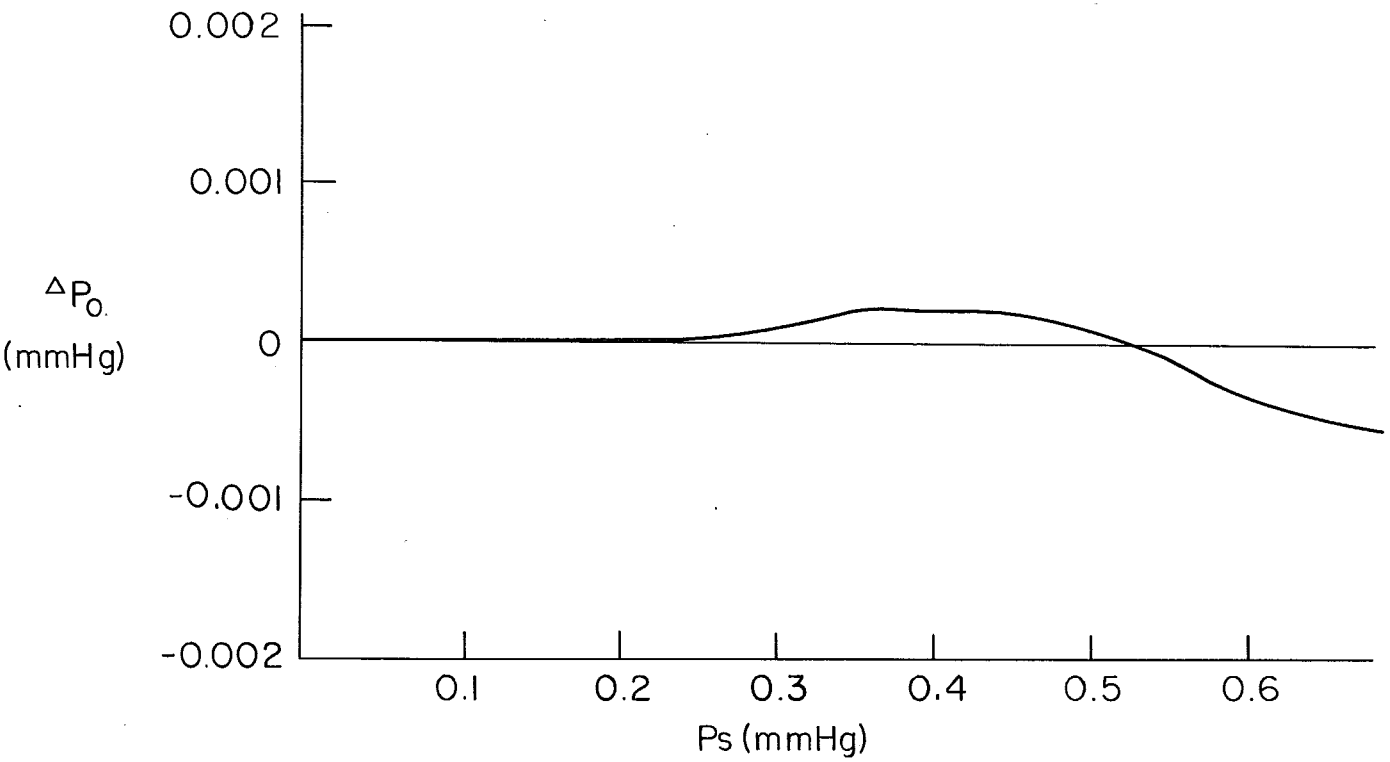
FIG. 6 is a graph showing the difference in pressure between the fluid outputs versus the pressure of the fluid inputs of the current invention.

FIG. 6 shows a plotting of a $\Delta p_o$, the difference between the pressure measured in the outputs, or the ordinate plotted against the supply pressure in a given instance, shown as the abscissa. This graph shows a minimal variation of the $\Delta p_o$ with respect to the supply pressure input producing a tuned amplifier.

From the description of the preferred embodiments, it is evident that the objects of the invention are attained in that the fluidic amplifier has a flow splitter which can be adjusted to accommodate any null offset shown. Although the invention has been described and illustrated in detail, it is to be clearly understood that the same is by way of illustration and example only, and is not to be taken by way of limitation.

I wish to be understood that I do not desire to be limited to the exact detailed construction shown and described, for obvious modifications can be made by a person skilled in the art.

I claim:

1. An apparatus comprising:
input means having a fluid supply means;
a fluid supply nozzle to supply fluid to a laminar flow proportional amplifier;
a plurality of fluid outputs;
control nozzle means to control fluid flow through said amplifier from said fluid supply nozzle to said fluid outputs, wherein said control nozzle means acts directly on said fluid to proportionally control said fluid output;
a flow splitter means to proportionally divide the fluid flow flowing from said fluid supply nozzle to said fluid outputs, said flow splitter being positioned rotatable and externally adjustable to split the flow between said outputs in order to apportion the fluid flow between the outputs; and
means to externally rotate said flow splitter means to effect a null offset.

2. The apparatus of claim 1 wherein there is a means to rotatably mount said flow splitter.

3. The apparatus of claim 2 wherein said fluid amplifier is interposed between a first flat backing plate and a second flat backing plate.

4. The apparatus of claim 3 wherein said flow splitter comprises a substantially triangular plate fixedly mounted on a rod means.

5. The apparatus of claim 4 where in said rod has a first portion rotatably mounted within an aperture in said first backing plate and has a second portion extending through a second backing plate.

6. The apparatus of claim 5 wherein said second portion of said rod is threaded and there is a means to hold said rod threaded engaged on said rod.

7. The apparatus of claim 6 wherein said rod is externally adjustable by rotation in said fluid amplifier to redirect fluid flow between said fluid outputs.

8. The apparatus of claim 7 wherein said means to hold said rod is a lock nut means.

* * * * *